US008536549B2

(12) United States Patent
Tao et al.

(10) Patent No.: US 8,536,549 B2
(45) Date of Patent: Sep. 17, 2013

(54) LIGHT SOURCE EMPLOYING LASER-PRODUCED PLASMA

(75) Inventors: Yezheng Tao, San Diego, CA (US); Mark S. Tillack, La Jolla, CA (US)

(73) Assignee: The Regents of the University of California, Oakland, CA (US)

( * ) Notice: Subject to any disclaimer, the term of this patent is extended or adjusted under 35 U.S.C. 154(b) by 620 days.

(21) Appl. No.: 12/296,707

(22) PCT Filed: Apr. 9, 2007

(86) PCT No.: PCT/US2007/066245

§ 371 (c)(1), (2), (4) Date: Nov. 11, 2009

(87) PCT Pub. No.: WO2007/121142

PCT Pub. Date: Oct. 25, 2007

(65) Prior Publication Data

US 2010/0051831 A1 Mar. 4, 2010

Related U.S. Application Data

(60) Provisional application No. 60/791,243, filed on Apr. 12, 2006.

(51) Int. Cl.
*G21K 5/00* (2006.01)

(52) U.S. Cl.
USPC ..... 250/504 R; 250/493.1; 315/111.21; 315/111.71; 313/231.31

(58) Field of Classification Search
USPC ..... 250/493.1, 503.1, 504 R; 315/111.21, 315/111.71; 313/231.31
See application file for complete search history.

(56) References Cited

U.S. PATENT DOCUMENTS

| | | | | |
|---|---|---|---|---|
| 6,339,634 | B1 | 1/2002 | Kandaka et al. | |
| 6,700,644 | B2 * | 3/2004 | Sweatt | 355/53 |
| 6,973,164 | B2 | 12/2005 | Hartlove et al. | |
| 7,239,686 | B2 | 7/2007 | Berglund et al. | |
| 7,361,918 | B2 | 4/2008 | Akins et al. | |
| 2003/0183603 | A1 * | 10/2003 | Forsman et al. | 219/121.6 |
| 2003/0223542 | A1 | 12/2003 | Shields | |

(Continued)

FOREIGN PATENT DOCUMENTS

WO 2009/140270 11/2009

OTHER PUBLICATIONS

Brandt, D.C., et al., "LPP EUV Source Development for HVM," Proceedings of SPIE, vol. 6517, pp. 65170Q(1-10), Mar. 2007.

(Continued)

*Primary Examiner* — Nicole Ippolito
(74) *Attorney, Agent, or Firm* — Perkins Coie LLP

(57) ABSTRACT

A system and a method of generating radiation and/or particle emissions are disclosed. In at least some embodiments, the system includes at least one laser source that generates a first pulse and a second pulse in temporal succession, and a target, where the target (or at least a portion the target) becomes a plasma upon being exposed to the first pulse. The plasma expand after the exposure to the first pulse, the expanded plasma is then exposed to the second pulse, and at least one of a radiation emission and a particle emission occurs after the exposure to the second pulse. In at least some embodiments, the target is a solid piece of material, and/or a time period between the first and second pulses is less than 1 microsecond (e.g., 840 ns).

24 Claims, 3 Drawing Sheets

(56) References Cited

U.S. PATENT DOCUMENTS

| | | | | |
|---|---|---|---|---|
| 2005/0129177 | A1* | 6/2005 | Berglund et al. | 378/119 |
| 2005/0205811 | A1* | 9/2005 | Partlo et al. | 250/504 R |
| 2006/0078017 | A1 | 4/2006 | Endo et al. | |
| 2006/0131515 | A1 | 6/2006 | Partlo et al. | |
| 2006/0140227 | A1* | 6/2006 | Rocca et al. | 372/5 |
| 2006/0163500 | A1* | 7/2006 | Inoue et al. | 250/493.1 |
| 2006/0255298 | A1 | 11/2006 | Bykanov et al. | |
| 2008/0023657 | A1 | 1/2008 | Melnychuk et al. | |
| 2010/0025231 | A1 | 2/2010 | Moriya et al. | |

OTHER PUBLICATIONS

De Groot, J.S., et al., "Density and temperature profiles in strongly absorbing plasma with distributed absorption," Physics of Fluids B: Plasma Physics, 3(5):1241-1244, May 1991.

Endo, A., et al., "CO2 laser-produced Sn plasma as the solution for high-volume manufacturing EUV lithography," Proceedings of the SPIE, vol. 6703, pp. 670309(1-8), Sep. 2007.

Fujioka, S., et al., "Opacity Effect on Extreme Ultraviolet Radiation from Laser-Produced Tin Plasmas," Physical Review Letters, 95(23):235004(1-4), Dec. 2005.

Garg, R., "Proximity printing using extreme ultraviolet radiation," Proceedings of SPIE, vol. 6921, pp. 69213M(1-6), Apr. 2008.

Harilal, S.S., et al., "Extreme-ultraviolet spectral purity and magnetic ion debris mitigation by use of low-density tin targets," Optics Letters, 31(10):1549-1551, May 2006.

International Search Report and Written Opinion mailed on Dec. 29, 2009 for International Application No. PCT/US2009/043614, filed May 12, 2009 (10 pages).

International Search Report and Written Opinion mailed on Jun. 24, 2008 for International Application No. PCT/US2007/066245, filed Apr. 9, 2007 (5 pages).

Nishihara, K., et al., "The Punch-Out Target," EUVL Source Workshop, San Diego, California, 8 pages, Nov. 2005.

Richardson, M. et al., "High conversion efficiency mass-limited Sn-based laser plasma source for extreme ultraviolet lithography," Journal of Vacuum Science & Technology B, 22(2):785-790, Mar. 2004.

Ruzic, D., et al., "Reducing ion energies and Sn ion data," EUVL Source Workshop, San Diego, California, 27 pages, Nov. 2005.

Shimada, Y., et al., "Characterization of extreme ultraviolet emission from laser-produced spherical tin plasma generated with multiple laser beams," Applied Physics Letters, 86(5):051501(1-3), Jan. 2005.

Silverman, P.J., et al., "Extreme ultraviolet lithography: overview and development status," Journal of Microlithography, Microfabrication, and Microsystems, 4(1):011006(1-5), Mar. 2005.

Stamm, U., "Extreme ultraviolet light sources for use in semiconductor lithography—state of the art and future development," Journal of Physics D: Applied Physics, 37(23):3244-3253, Dec. 2004.

Tanaka, H., et al., "Comparative study on emission characteristics of extreme ultraviolet radiation from CO2 and Nd: YAG laser-produced tin plasmas," Applied Physics Letters, 87(4):041503(1-3), Jul. 2005.

Tao, Y., et al., "Characterization of density profile of laser-produced Sn plasma for 13.5 nm extreme ultraviolet source," Applied Physics Letters, 86(20):201501(1-3), May 2005.

Tao, Y., et al., "Dynamics of laser-produced Sn-based plasmas for a monochromatic 13.5 nm extreme ultraviolet source," Proceedings of the SPIE, vol. 6703, pp. 67030A(1-8), Sep. 2007.

Tao, Y., et al., "Mass-limited Sn target irradiated by dual laser pulses for an extreme ultraviolet lithography source," Optics Letters, 32(10):1338-1340, May 2007.

Tao, Y., et al., "Mitigation of fast ions from laser-produced Sn plasma for an extreme ultraviolet lithography source," Applied Physics Letters, 89(11):111502(1-3), Sep. 2006.

Ueno, Y., et al., "Efficient extreme ultraviolet plasma source generated by a CO2 laser and a liquid xenon microjet target," Applied Physics Letters, 90(19):191503(1-3), May 2007.

Ueno, Y., et al., "Enhancement of extreme ultraviolet emission from a CO2 laser-produced Sn plasma using a cavity target," Applied Physics Letters, 91(23):231501(1-3), Dec. 2007.

White, J., et al., "Optimizing 13.5 nm laser-produced tin plasma emission as a function of laser wavelength," Applied Physics Letters, 90(18):181502(1-3), Apr. 2007.

* cited by examiner

LIGHT SOURCE EMPLOYING LASER-PRODUCED PLASMA

CROSS-REFERENCE TO RELATED APPLICATIONS

This application claims the benefit of U.S. provisional patent application No. 60/791,243 entitled "Improved Light Source Employing Laser-Produced Plasma" filed on Apr. 12, 2006, which is hereby incorporated by reference herein.

STATEMENT REGARDING FEDERALLY SPONSORED RESEARCH OR DEVELOPMENT

This invention was made with government support under DE-FG03-99ER54547 awarded by Department of Energy. The government has certain rights in this invention.

FIELD OF THE INVENTION

The present invention relates to light sources and, more particularly, to light sources involving the generation of laser-produced plasmas.

BACKGROUND OF THE INVENTION

In order to achieve higher density semiconductor circuits, it is desired that higher optical-resolution lithographic light sources be developed. Since resolution scales linearly with wavelength, many in the semiconductor industry view extreme ultraviolet lithography (EUVL) technology as a promising technology that in coming years will be used to produce smaller and faster microchips with feature sizes of 32 nm or less.

Several issues remain to be addressed before EUVL can be successfully applied in high volume semiconductor production. One is the need to develop a high-power, long-lifetime EUVL light source. Extreme ultraviolet light (EUV) is essentially "soft X-ray" emission, and light sources involving the generation of laser-produced plasmas (LPPs) have been one of the most promising candidates for providing such emissions. Indeed, recent international efforts have resulted in great progress in enhancing the conversion efficiency achieved in such light sources.

EUVL light sources can employ a high repetition rate laser (10-100 kHz) with 100-1000 mJ pulse energy, and operate by irradiating a metal target with the high-power laser radiation to cause the target material to be vaporized into a plasma with excited metal atoms and ions. The excited metal atoms and ions in turn emit the desired soft X-rays, which are then collected and transported onto a photoresist coated wafer. Further detailed information regarding the design of such light sources can be obtained in "Extreme ultraviolet light sources for use in semiconductor lithography—state of the art and future development" by Uwe Stamm (J. Phys. D: Appl. Phys. 37 (2004) 3244-3253), which is hereby incorporated by reference herein.

Notwithstanding the promise of such light sources, a remaining significant problem in implementing EUVL light sources is the generation of energetic debris from the plasmas, which can damage the optics in a EUVL light source. For example, while solid density tin targets offer the highest in-band conversion efficiency and the simplest target supply for high repetition rate operation, such targets result in high kinetic energy debris and subsequent optic damage that limits the source lifetime.

Various attempts have been made to solve the problem of fast particle damage. Conventional techniques include the use of low-density tin-doped foam targets, tin-doped water droplet targets, or shockwave punch-out foils, the addition of low impedance (Z) elements into solid density tin, the use of electric and magnetic fields, and the addition of a background gas. Nevertheless, all of these techniques suffer from serious drawbacks, including limited effectiveness (e.g., below industry requirements on ion dose to the optics), reduced conversion efficiency, and the addition of undesirable impurities and complexity.

For at least these reasons, it would be advantageous if an improved light source involving the generation of LPP(s) could be developed. It would in particular be advantageous if, in at least some embodiments, the system operated in a manner such that the amount of high kinetic energy debris, and consequent optic or other damage resulting from such debris, were reduced so as to increase the operational lifetime of the light source.

SUMMARY OF THE INVENTION

The present inventors have recognized that pre-pulses can be employed in generating LPPs such as, for example, Sn-based plasmas. Further, the present inventors have recognized that the use of such pre-pulses in generating LPPs can reduce the generation of fast ions from the LPPs, and thus can be useful in achieving longer-lasting light sources including, for example, EUVL light sources, EUV light sources for microscopy, pulsed laser deposition (PLD) particle sources and LPP x-ray sources.

In at least some embodiments of the present invention, a EUVL light source involving a LPP includes a standard main laser pulse together with an extra early laser pulse. The early laser pulse produces a pre-plasma with a finite density gradient. The pre-formed target plasma isolates the direct interaction of laser pulse with the sharp density jump at the target surface. More than 30 times reduction in ion kinetic energy is thus obtained with almost no loss of conversion efficiency (in terms of laser input to plasma emission). This is a higher reduction in ion energy than any existing techniques, and enables a large reduction in the amount of ablated material reaching the optics and other sensitive elements. Further, this enables the use of solid density targets (rather than requiring the use of complicated, expensive, or lower conversion efficiency low-density Sn-doped foam, fiber, or droplet targets). The cost of implementation is low, and the technique can be easily coupled into existing designs of laser plasma systems and/or EUVL systems, used in conjunction with existing Sn-doped droplet and low density foam targets, and/or used in combination with conventional methods to mitigate debris such as the use of buffer (or background or "stopping") gas to restrict the movement/discharge of debris, or the use of electric fields to reduce debris output.

Further, in at least some embodiments, the present invention relates to a system that includes at least one laser source that generates a first pulse and a second pulse in temporal succession, and a target including a first solid material. At least a portion of the first solid material becomes a plasma upon being exposed to the first pulse. Also, the plasma expands after the exposure to the first pulse, the expanded plasma is then exposed to the second pulse, and at least one of a radiation emission and a particle omission occurs after the exposure to the second pulse. In at least some other embodiments, the target need not be or include a solid material (for example, the target can be or include a first liquid material).

Additionally, in at least some embodiments, the present invention relates to radiation generation system that includes at least one laser source that generates a first pulse and a second pulse in temporal succession, and a target at least a part of which becomes a plasma upon being exposed to the first pulse. The plasma expands after the exposure to the first pulse, the expanded plasma is then exposed to the second pulse, and a radiation emission occurs after the exposure to the second pulse. The second pulse occurs subsequent to the first pulse by a time period, and wherein the timer period is less than 1 microsecond.

Further, in at least some embodiments, the present invention relates to a method of generating radiation. The method includes generating a first laser pulse, generating a second laser pulse, exposing a target to the first laser pulse at a first time, so as to produce an expanded plasma, and exposing the expanded plasma to the second laser pulse at a second time, the second time being later than the first time. The exposing of the expanded plasma to the second laser pulse results in a radiation emission, and also at least one of the following is true: the target is made from a solid material, and a period separating the first and second laser pulses is less than 1 microsecond in length. In at least some other embodiments, the target need not be or include a solid material (for example, the target can be or include a first liquid material).

DETAILED DESCRIPTION OF THE PREFERRED EMBODIMENT

Figure 1:
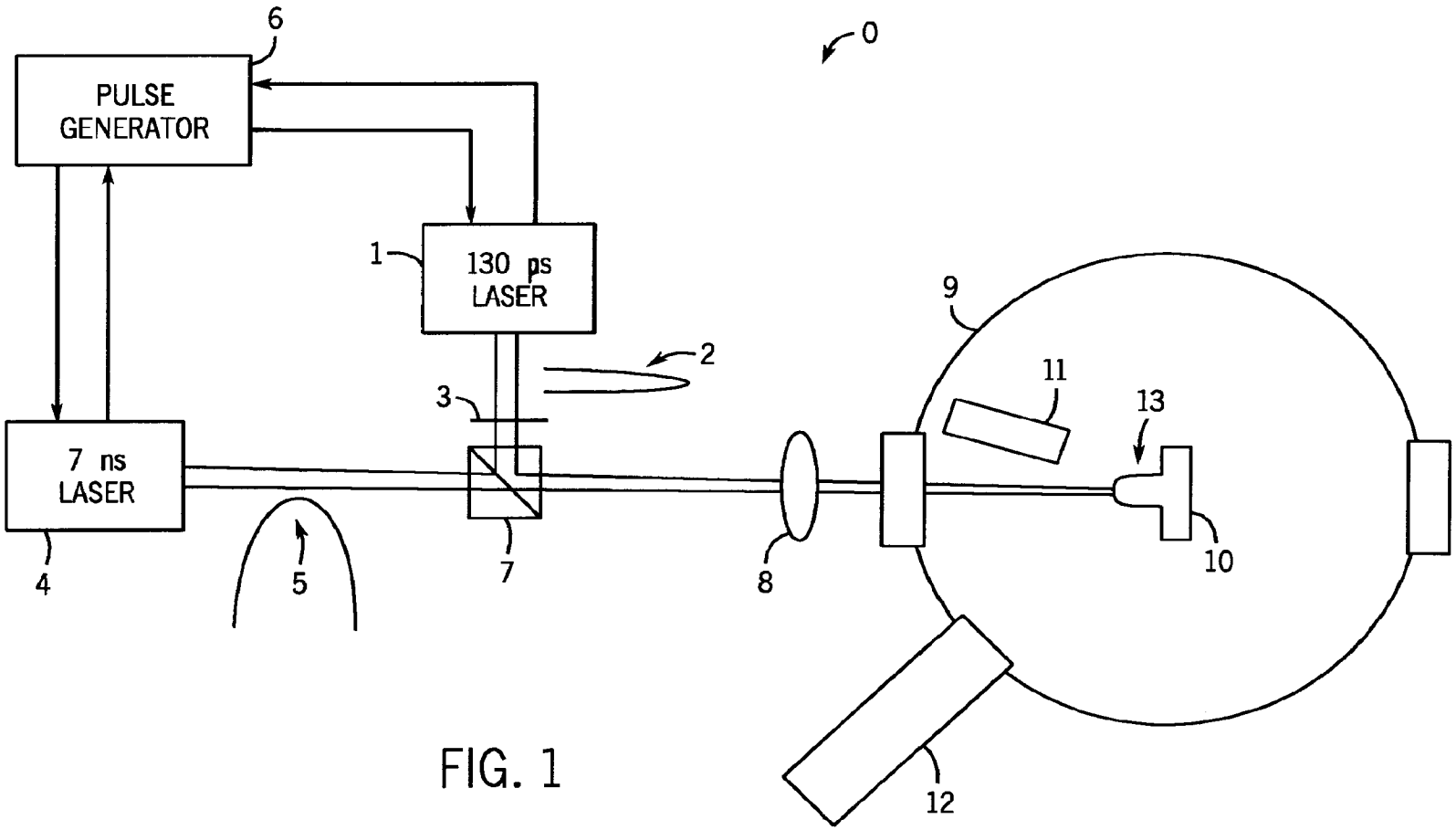
FIG. 1 is a schematic diagram showing an exemplary extreme ultraviolet lithography light source based on laser-produced plasma with an extra early laser pulse.

Referring to FIG. 1, a schematic diagram shows an exemplary extreme ultraviolet lithography (EUVL) light source 0 in accordance with at least some embodiments of the present invention, in which the light source involves generation of a laser-produced plasma (LPP) and is driven by dual pulses. More particularly, the light source 0 includes an "early pulse" or pre-pulse laser 1 that is capable of repeatedly emitting a sub-nanosecond, early laser pulse 2. The pre-pulse polarization of the pulse 2 is rotated with a waveplate 3. Additionally, the light source 0 includes a main laser 4 that is capable of repeatedly emitting a longer, main laser pulse 5 having a width of several nanoseconds. In the present embodiment, the lasers 1 and 4 are 1 micron solid-state Nd-YAG lasers, albeit other types of lasers can be used in other embodiments (e.g., other short-pulse laser systems, carbon dioxide lasers, etc.).

As will be described further below, typically the light source 0 is operated so that a pair of the respective pulses 2, 5 occur in succession, that is, with the pulse 2 being followed by the pulse 5. The delay time between the pulsing of the pre-pulse laser 1 and main laser 4 is controlled with a pulse generator and delay unit 6, which is coupled to each of the lasers. Although the delay time can vary depending upon the embodiment, in at least some embodiments a delay time of 840 nanoseconds has been found to result in best performance. As illustrated, in the present embodiment control and monitoring signals are respectively communicated from and to the pulse generator and delay unit 6 to and from each of the laser 1 and the laser 4 (e.g., bidirectional communications occur between the pulse generator and delay unit and each of the lasers). In alternate embodiments, communications can occur in some other manner. For example, the pulse generator and delay unit 6 might only send control signals to each of the lasers 1, 4 but not receive any feedback or other signals from the lasers.

Further as shown, in the present embodiment the light source 0 also includes a polarizing cube beamsplitter or simply cube polarizer 7 at which the two laser pulses 2 and 5 are combined into a co-linear optical path. Upon being combined, the resulting overall laser pulse (e.g., the combination of the pulses) is focused at normal incidence onto a target 10 by way of a convex-planar lens 8 positioned between the cube polarizer 7 and the target 10. In the present embodiment, albeit not necessarily, the target 10 is a solid density Sn (tin) target that is placed inside of a vacuum chamber 9. Also, within the vacuum chamber 9 is a Faraday cup 11, and adjacent the vacuum chamber can be positioned an EUV energy monitor 12. As described further with reference to FIGS. 2(*a*)-(*c*), exposure of the target 10 to the laser pulses results in the creation of a Sn LPP, namely, a plasma 13.

Figure 2:
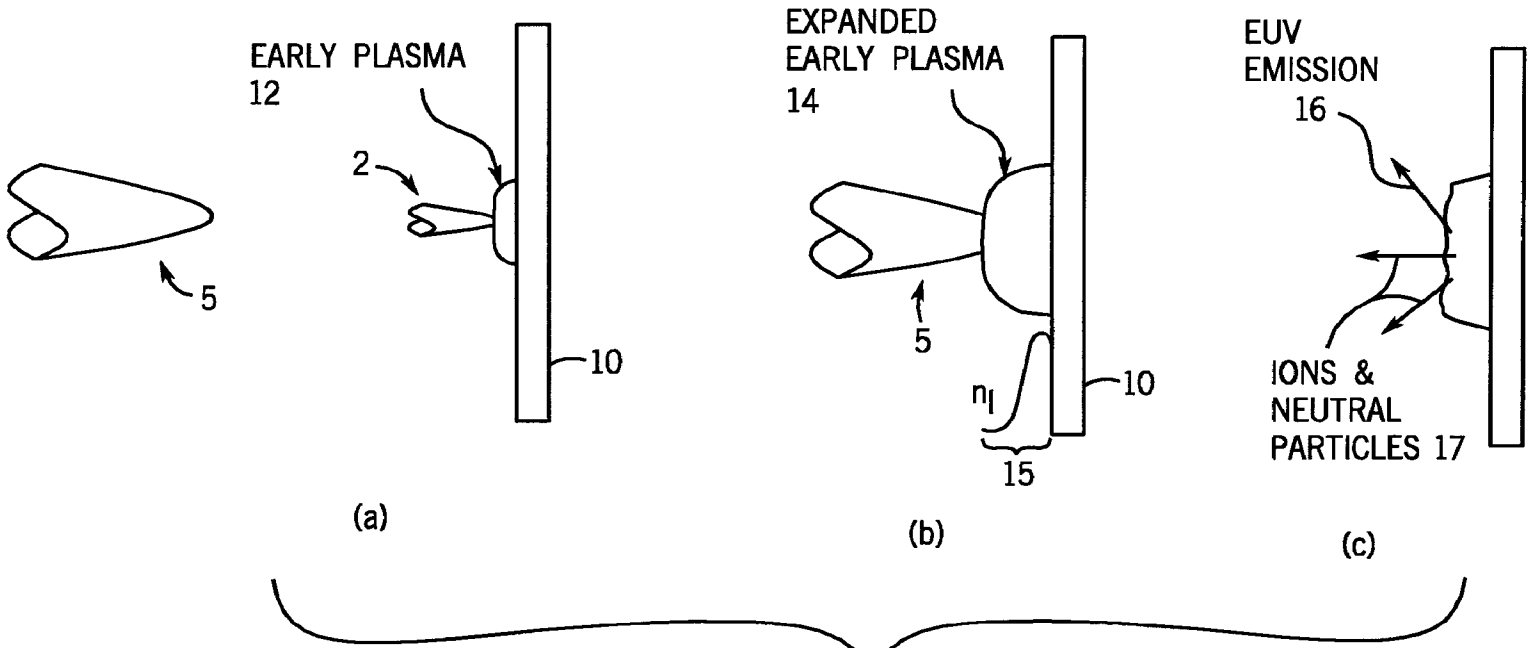
FIGS. 2(*a*)-(*c*) show an exemplary sequence of events when a pre-plasma is generated and a main pulse interacts with it in the light source of FIG. 1.

Referring additionally then to FIGS. 2(*a*)-(*c*), an exemplary working sequence of the EUVL light source 0 with the early laser pulse 2 is illustrated, particularly in relation to the generation of the Sn LPP by the early laser pulse. First, as shown in FIG. 2(*a*), the early laser pulse 2 (corresponding to that shown in FIG. 1) irradiates the target 10, which in this embodiment is a Sn target. As a result, early plasma 12 is generated. At this time, as shown, the main laser pulse 5 (corresponding to the main laser pulse 5 of FIG. 1) has not yet arrived at the target 10. Subsequently after a delay, as shown in FIG. 2(*b*), the main laser pulse 5 interacts with an expanded early plasma 14 at a lower density.

Turning to FIG. 2(*c*), as a result of the main laser pulse 5 interacting with the expanded early plasma 14, the expanded early plasma is heated up to a favorable temperature (e.g., 30-60 eV), after which EUV emission 16 as well as ions and neutral particles 17 are generated. Although FIG. 2(*c*) shows the EUV emission 16 to be represented by one arrow pointing in one direction and the ions and neutral particles 17 to be represented by two other arrows pointing in other directions, it will be understood that each of the EUV emission, ions and neutral particles proceed in all directions (and particularly away from the target 10).

In the present embodiment involving a Sn target, therefore, the early laser pulse 2 tends to create the early plasma by vaporizing and partially ionizing Sn atoms. The second, main laser pulse 5 in turn tends to heat up the already-ionized Sn atoms, so as to excite some of the remaining electrons of the atoms to bring about the emission of desired EUV. While the main laser pulse 5 also can contribute to the generation of ions and other particles, the amount of high kinetic energy debris resulting from the main laser pulse is less than that which is produced by way of conventional light sources. This can be explained as follows.

As illustrated in FIG. 2(*b*), at the time at which the main laser pulse 5 interacts with the expanded early plasma 14, the plasma 14 has an ion density ($n_i$) profile 15 that is largely "S-shaped" as shown, and thus is nearly Gaussian in its distribution (particularly as one moves away from the surface of the target 10). Further, while most of the energy of the early laser pulse 2 interacts directly with the target 10 and is deposited within the early plasma 12, most of the energy of the main laser pulse 5 interacts with the portion of the expanded early plasma 14 that has the Gaussian ion density with a finite density gradient (which is positioned slightly away from the surface of the target 10), rather than the portion of the expanded early plasma having a sharp density gradient at the solid density surface of the target 10. Because the main laser pulse 5 thus primarily interacts with the near Gaussian density profile, this interaction produces ions and neutral particles with much lower energy as compared with what would be produced by an interaction with a sharp density gradient target.

Figure 3:
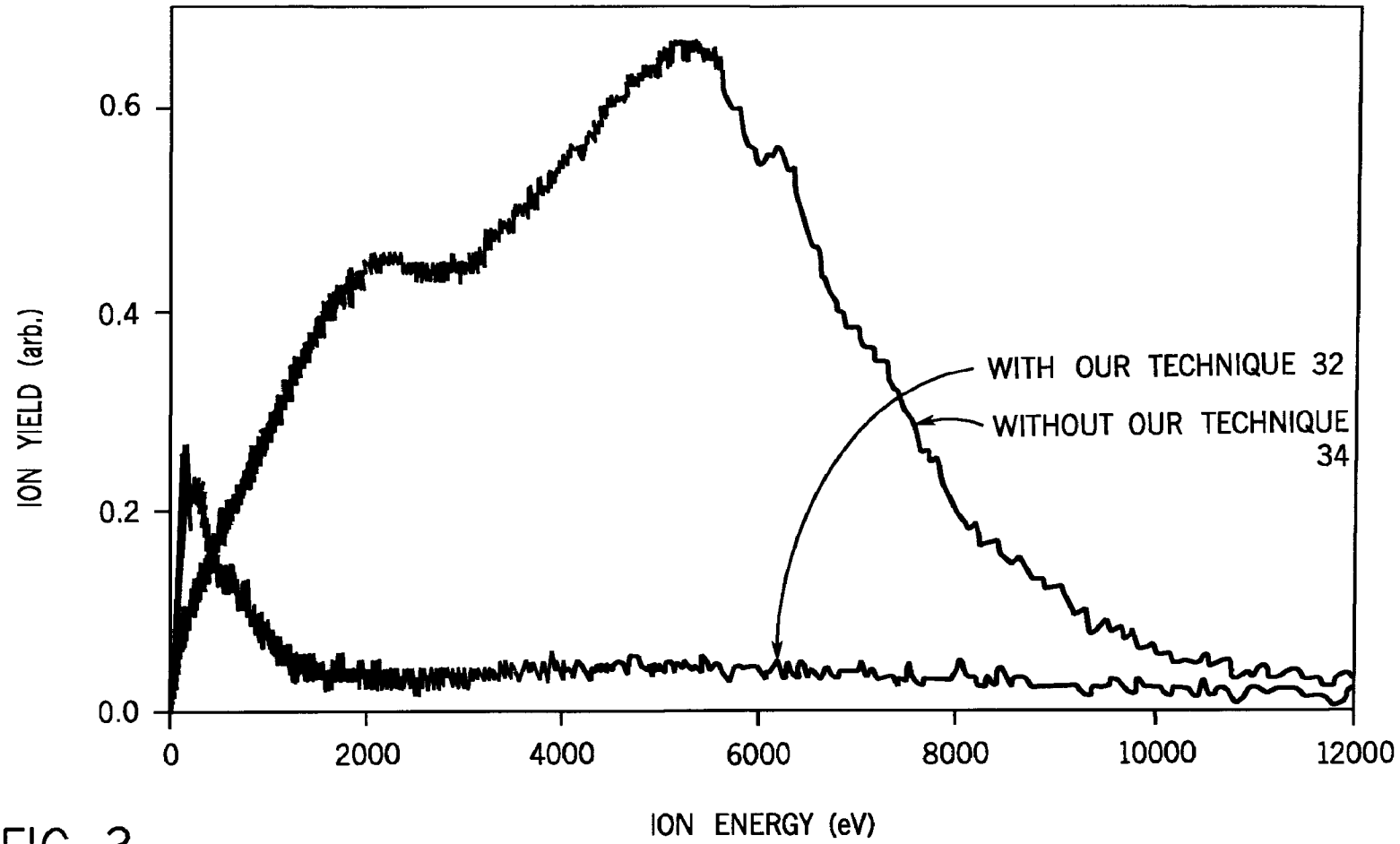
FIG. 3 shows exemplary experimental results showing the energy spectra of ions from laser-produced Sn plasmas both with and without an extra early laser pulse.

Additionally referring to FIG. 3, a first graph 32 shows a first exemplary ion spectrum realized from a Sn LPP generated with an early laser pulse in addition to a main laser pulse, in accordance with embodiments of the present invention, and a second graph 34 shows a second exemplary ion spectrum realized from the same Sn LPP when it is generated without such an early laser pulse (and using the same main laser pulse). As shown by the second graph 34, without the early laser pulse, most of the ions are found above 2 keV, and the peak ion flux is centered around 5 keV. In comparison, with an early laser pulse as shown by the first graph 32, most of the ions have energy below 500 eV, with the peak flux centered around 150 eV. In addition, the total ion flux is significantly reduced when the early laser pulse is employed rather than not employed.

Table 1 further shows two exemplary in-band conversion efficiencies, in terms of the conversion of energy from a laser to 13.5 nm EUV emission from LPPs, where the EUV emission is generated by way of a light source (such as the light source 0) employing an early laser pulse and also a conventional light source not employing an early laser pulse. As shown, for the light source employing the early laser pulse, the conversion efficiency is only reduced about 5% or even less than 5% (e.g., 5% of 2.0% as shown in Table 1) relative to the conventional light source not employing an early laser pulse. Thus, the various advantages achieved by embodiments of the present invention employing early laser pulses can be achieved without significant sacrifices in the operating efficiency of the EUV emission process.

TABLE 1

Measured conversion efficiencies

| Technique | In-band conversion efficiency |
|---|---|
| Early Laser Pulse + Main Laser Pulse | 1.9% |
| Main Laser Pulse Only | 2.0% |

Various aspects of the devices, structures and processes described above can vary depending upon the embodiment. For example, while in the embodiment of FIGS. 1 and 2(*a*)-2(*c*), the target 10 is a solid Sn slab of material having a substantially flat planar surface toward which the pulses 2 and 5 are substantially normally directed (as illustrated in the figures), in other embodiments the target 10 can be a slab of material that is not substantially planar (e.g., a slab having a concave or convex surface). Further, in other embodiments, the target 10 can instead or in addition involve one or more (e.g., Sn-doped) droplets or microdroplets (e.g., 50 to 100 microns in diameter) and/or low density foam targets. Also, in other embodiments, the target 10 can be made from a material (or multiple materials) other than Sn (including many if not most elements of the periodic table).

Additionally, at least some embodiments of the present invention employing a methodology involving early and main laser pulses as described above can also be implemented in combination with conventional methods to limit or mitigate debris, such as the use of buffer (or background or "stopping") gas to restrict the movement/discharge of debris (in which case the amount of such gas that is used can be reduced relative to conventional methods), or the use of electric fields to reduce debris output. Notwithstanding the above comments regarding alternate embodiments of the invention, however, it is a significant advantage of at least some embodiments of the presently-described EUVL light source 0 (in comparison with some conventional light sources) that these embodiments can be used in conjunction with target(s) that are solid and/or of various geometries, rather than restricted to use only with droplets.

Also for example, the lengths and amounts of energy, and temporal spacing between, the laser pulses 2 and 5 can vary depending upon the embodiment. In some embodiments, the early laser pulse 2 is a sub-nanosecond pulse at a low energy level, for example, a pulse having a pulse duration of 100 picoseconds or more (e.g., 130 picoseconds, or several 100 picoseconds) and an energy level on the order of about 2 mJ or less. Further, in at least some embodiments, the length of the main laser pulse 5 is 7 nanoseconds, and the main laser pulse contains an amount of energy in the range of about 200 mJ to 2 J (and often either about 1 J or 0.5 J). It should be noted that, while the amounts of energy in the different laser pulses are of some significance, the energy intensities/densities of the pulses also are of significance. Additionally, in at least some embodiments, the delay between the pulses 2, 5 is anywhere from 800 nanoseconds to 1500 nanoseconds in length. The length of the delay between the pulses 2, 5 is determined as the length that is appropriate for achieving the desired substantially-Gaussian ion density gradient (e.g., corresponding to the ion density ($n_i$) profile 15 discussed above with respect to FIG. 2(*b*)).

With these assumed values, a more than 30 times reduction in particle energy can be achieved using the light source 0 in comparison with conventional light sources, even though there is very little loss of conversion efficiency in switching from the conventional light source to the light source 0. Further, in some such embodiments, an optimum delay time between the early and main laser pulses 2, 5 to obtain simultaneously a high reduction in particle energy and a high conversion efficiency is 840 nanoseconds. Nevertheless, in other embodiments other energy levels, pulse durations, and pulse spacings are possible. For example, more than two (e.g., three) pulses can be employed in some alternate embodiments. Also, in some alternate embodiments, it is possible for a continuous or substantially continuous waveform (or waveforms) having any arbitrary number or types of pulses or pulse-like characteristics can be generated. In some alternate embodiments, the two or more pulses or other waveform(s) can be generated by a single laser or more than two lasers, in contrast to the embodiment of FIG. 1 in which the two lasers 1, 4 are employed.

Embodiments of the present invention are intended to be applicable in connection with a variety of different types of light (or radiation) sources employing laser-produced plasmas (LPPs), and in a variety of different circumstances. For example, embodiments of the present invention can be employed in extreme ultraviolet lithography (EUVL) light sources such as those used for (or potentially useful in the future in connection with) semiconductor manufacture involving lithography and/or other lithographic procedures. Also for example, embodiments of the present invention can be employed in EUVL and/or other light sources used for microscopy (e.g., medical microscopy) as well as in laser-produced plasma x-ray sources. Additionally for example, embodiments of the present invention can be employed in pulsed laser deposition (PLD) particle sources. In such embodiments, the impacting of the laser pulses upon the target results in the emission of particles (of the target material) that are in turn deposited upon a substrate.

As discussed above, embodiments of the present invention can have several advantages in comparison with alternative (e.g., conventional) techniques. For example, in at least some embodiments, the present invention achieves higher reduction factors in ion energy (and thus in terms of the total ablation rate, the amount of ablated material, and the generation of debris) than any existing technology, with little loss of conversion efficiency (in at least some embodiments, more than 30 times reduction can be achieved in terms of laser input to plasma emission). Also, at least some embodiments of the present invention are relatively simple and inexpensive to manufacture and/or operate.

Further, at least some embodiments of the present invention can be implemented in connection with various types of targets, including for example, tin targets and solid density tin targets of various shapes and sizes (e.g., slabs having planar, convex or concave surfaces). The cost of implementation is low, and the technique can be easily coupled into existing designs of laser plasma systems and/or EUVL systems, used in conjunction with existing Sn-doped droplet and low density foam targets, and/or used in combination with conventional methods to mitigate debris such as methods involving the use of buffer gas or electric fields, among others. In at least some embodiments of the invention, a microprocessor or another control mechanism is implemented in connection with the light source 0 (or other light source) to control its operation or a portion thereof (e.g., in connection with the pulse generator and delay unit 6).

It is specifically intended that the present invention not be limited to the embodiments and illustrations contained herein, but include modified forms of those embodiments including portions of the embodiments and combinations of elements of different embodiments as come within the scope of the following claims.

We claim:

1. A system comprising:

at least one laser source that generates a first pulse and a second pulse, wherein the first pulse and the second pulse are separated from one another by a non-zero time interval; and a target including a first solid material, wherein at least a portion of the first solid material becomes a plasma upon being exposed to the first pulse, wherein the plasma expands after the exposure to the first pulse, wherein the expanded plasma is then exposed to the second pulse, wherein a radiation emission occurs only after the exposure to the second pulse and wherein a reduction in high-kinetic energy debris produced as a result of exposure of the target to the first and the second pulse is more than one-half compared to a system in which the first pulse is absent.

2. The system of claim 1, wherein the at least one laser source includes a first laser source and a second laser source and a pulse control mechanism that governs when the first laser source and the second laser source emit the first and second pulses, respectively.

3. The system of claim 2, wherein the at least one laser source includes at least one short-pulse, solid-state Nd-YAG laser.

4. The system of claim 1, further comprising at least one of a cube polarizer, a lens and a waveplate, by which at least one of the first pulse and the second pulse proceeds from the at least one laser source to the target.

5. The system of claim 1, wherein the target is supported within a vacuum chamber, and further comprising at least one of Faraday cup and an extreme ultraviolet (EUV) energy monitor.

6. A semiconductor lithography system employing the system of claim 1, wherein the radiation emission is an EUV emission.

7. The system of claim 1, wherein the system is configured for use in one of a lithography system, in a microscopy-related system, in a pulsed laser deposition (PLD) particle source system, and in a laser-produced plasma (LPP) x-ray source.

8. The system of claim 7, wherein the system is configured for use in a microscopy-related system that is intended for use in a medical application.

9. The system of claim 1, wherein the system operates as a EUVL light source involving a laser-produced plasma (LPP).

10. The system of claim 9, wherein at least one of the following is true:

the first pulse of the EUVL light source has about or less than 2 mJ; and a first pulse duration of the first pulse is about or greater than 100 ps.

11. The system of claim 9, wherein at least one of the following is true:

the second pulse of the EUVL light source has between 200 mJ and 2 J; and a second pulse duration of the second pulse is approximately 7 ns.

12. The system of claim 9, wherein the non-zero time interval between the first and second pulses is between 800 ns and 1500 ns.

13. The system of claim 12, wherein the delay time is about 840 ns.

14. The system of claim 1, wherein the expanded plasma has a near-Gaussian density profile, and wherein most of the second pulse interacts with the expanded plasma characterized by the near-Gaussian density profile.

15. The system of claim 14, wherein the non-zero time interval between the first and second pulses is set so that the expanded plasma having the near-Gaussian density profile exists when the second pulse arrives.

16. The system of claim 1, further comprising at least one of:

buffer gas means for reducing first debris emission; and electric field means for reducing second debris emission.

17. A radiation generation system comprising:

at least one laser source that generates a first pulse and a second, wherein the first pulse and the second pulse are separated from one another by a non-zero time interval; and a target at least a part of which becomes a plasma upon being exposed to the first pulse, wherein the plasma expands after the exposure to the first pulse, wherein the expanded plasma is then exposed to the second pulse, wherein a radiation emission occurs only after the exposure to the second pulse, and wherein a reduction in high-kinetic energy debris produced as a result of exposure of the target to the first and the second pulse is more than one-half compared to a system in which the first pulse is absent, and wherein the non-zero time interval is less than 1 microsecond.

18. The radiation generation system of claim 17, wherein the non-zero time interval is about 840 ns.

19. The radiation generation system of claim 17, wherein the target includes at least one of:

a solid slab of material; and a plurality of droplets.

20. The radiation generation system of claim 19, wherein the target is made from tin, and wherein the radiation generation system includes first and second lasers for generating the first and second pulses, respectively, the first and second lasers being controlled by a control devices.

21. The radiation generation system of claim 1, wherein the system is configured for use in one of a lithography system, in a microscopy-related system, and in a laser-produced plasma (LPP) x-ray source.

22. A method of generating radiation, the method comprising:

generating a first laser pulse;

generating a second laser pulse;

exposing a target to the first laser pulse at a first time, so as to produce an expanded plasma; and exposing the expanded plasma to the second laser pulse at a second time, wherein the first laser pulse and the second laser pulse are separated from one another by a non-zero time interval, the second time being later than the first time, wherein only after exposing of the expanded plasma to the second laser pulse a radiation emission occurs, wherein a reduction in high-kinetic energy debris produced as a result of exposure of the target to the first and the second pulse is more than one-half compared to a system in which the first pulse is absent, and wherein at least one of the following is true: the target is made from a solid material, and the non-zero time interval between the first and second laser pulses is less than 1 microsecond in length.

23. The method of claim 22, wherein the expanded plasma has a substantially Gaussian ion density profile.

24. The system of claim 22, wherein the reduction is more than 30 times.

* * * * *